US010327072B2

(12) United States Patent
Lafort et al.

(10) Patent No.: US 10,327,072 B2
(45) Date of Patent: Jun. 18, 2019

(54) PHASE CORRECTING SYSTEM AND A PHASE CORRECTABLE TRANSDUCER SYSTEM

(71) Applicant: Sonion Nederland B.V., Hoofddorp (NL)

(72) Inventors: Adrianus Maria Lafort, Hoofddorp (NL); Dion Ivo de Roo, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/816,099

(22) Filed: Nov. 17, 2017

(65) Prior Publication Data

US 2018/0146286 A1 May 24, 2018

(30) Foreign Application Priority Data

Nov. 18, 2016 (EP) ..... 16199657

(51) Int. Cl.

| | |
|---|---|
| ***H04R 3/04*** | (2006.01) |
| ***H04R 1/32*** | (2006.01) |
| ***H04R 19/04*** | (2006.01) |
| ***H04R 29/00*** | (2006.01) |
| *H04R 3/00* | (2006.01) |
| *H04R 3/06* | (2006.01) |
| *H04R 19/00* | (2006.01) |

(52) U.S. Cl.

CPC ..... *H04R 3/04* (2013.01); *H04R 1/326* (2013.01); *H04R 19/04* (2013.01); *H04R 29/006* (2013.01); *H04R 3/005* (2013.01); *H04R 3/06* (2013.01); *H04R 19/005* (2013.01)

(58) Field of Classification Search

CPC ..... H04R 1/326; H04R 3/04

See application file for complete search history.

(56) References Cited

U.S. PATENT DOCUMENTS

| | | | |
|---|---|---|---|
| 6,788,796 | B1 | 9/2004 | Miles |
| 6,831,577 | B1 | 12/2004 | Furst |
| 6,853,290 | B2 | 2/2005 | Jorgensen |
| 6,859,542 | B2 | 2/2005 | Johannsen |
| 6,888,408 | B2 | 5/2005 | Furst |
| 6,914,992 | B1 | 7/2005 | van Halteren |

(Continued)

FOREIGN PATENT DOCUMENTS

| | | | |
|---|---|---|---|
| EP | 1553696 | A1 | 7/2005 |
| EP | 2648333 | A3 | 10/2013 |

(Continued)

OTHER PUBLICATIONS

Extended European Search Report in European Patent Application No. EP 16199651, dated Mar. 31, 2017 (3 pages).

(Continued)

*Primary Examiner* — Mohammad K Islam

(74) *Attorney, Agent, or Firm* — Nixon Peabody LLP

(57) ABSTRACT

A phase correcting system for connection with a transducer. The phase correction may take place before amplifying the output of the transducer. The phase correction system comprises a circuit configured to low-pass filter an input and feed the output to the non-signal terminal of the transducer. This circuit may comprise a transconductance amplifier.

11 Claims, 5 Drawing Sheets

(56) References Cited

U.S. PATENT DOCUMENTS 6,919,519 B2 7/2005 Ravnkilde
6,930,259 B1 8/2005 Jorgensen
6,943,308 B2 9/2005 Ravnkilde
6,974,921 B2 12/2005 Jorgensen
7,008,271 B2 3/2006 Jorgensen
7,012,200 B2 3/2006 Moller
7,062,058 B2 6/2006 Steeman
7,062,063 B2 6/2006 Hansen
7,072,482 B2 7/2006 Van Doom
7,088,839 B2 8/2006 Geschiere
7,110,560 B2 9/2006 Stenberg
7,136,496 B2 11/2006 van Halteren
7,142,682 B2 11/2006 Mullenbom
7,149,317 B2 12/2006 Lafort
7,181,035 B2 2/2007 van Halteren
7,190,803 B2 3/2007 van Halteren
7,206,428 B2 4/2007 Geschiere
7,221,766 B2 5/2007 Boor
7,221,767 B2 5/2007 Mullenbom
7,221,769 B1 5/2007 Jorgensen
7,227,968 B2 6/2007 van Halteren
7,239,714 B2 7/2007 de Blok
7,245,734 B2 7/2007 Niederdraenk
7,254,248 B2 8/2007 Johannsen
7,286,680 B2 10/2007 Steeman
7,292,700 B1 11/2007 Engbert
7,292,876 B2 11/2007 Bosh
7,336,794 B2 2/2008 Furst
7,376,240 B2 5/2008 Hansen
7,403,630 B2 7/2008 Jorgensen
7,415,121 B2 8/2008 Mögelin
7,425,196 B2 9/2008 Jorgensen
7,460,681 B2 12/2008 Geschiere
7,466,835 B2 12/2008 Stenberg
7,492,919 B2 2/2009 Engbert
7,548,626 B2 6/2009 Stenberg
7,657,048 B2 2/2010 van Halteren
7,684,575 B2 3/2010 van Halteren
7,706,561 B2 4/2010 Wilmink
7,715,583 B2 5/2010 Van Halteren
7,728,237 B2 6/2010 Pedersen
7,809,151 B2 10/2010 Van Halteren
7,822,218 B2 10/2010 Van Halteren
7,899,203 B2 3/2011 Van Halteren
7,912,240 B2 3/2011 Madaffari
7,946,890 B1 5/2011 Bondo
7,953,241 B2 5/2011 Jorgensen
7,961,899 B2 6/2011 Van Halteren
7,970,161 B2 6/2011 van Halteren
8,098,854 B2 1/2012 van Halteren
8,101,876 B2 1/2012 Andreasen
8,103,039 B2 1/2012 van Halteren
8,160,290 B2 4/2012 Jorgensen
8,170,237 B2 5/2012 Shajaan
8,170,249 B2 5/2012 Halteren
8,189,804 B2 5/2012 Hruza
8,189,820 B2 5/2012 Wang
8,223,981 B2 7/2012 Haila
8,223,996 B2 7/2012 Beekman
8,233,652 B2 7/2012 Jorgensen
8,259,963 B2 9/2012 Stenberg
8,259,976 B2 9/2012 van Halteren
8,259,977 B2 9/2012 Jorgensen
8,280,082 B2 10/2012 van Halteren
8,284,966 B2 10/2012 Wilk
8,313,336 B2 11/2012 Bondo
8,315,422 B2 11/2012 van Halteren
8,331,595 B2 12/2012 van Halteren
8,369,552 B2 2/2013 Engbert
8,379,899 B2 2/2013 van Halteren
8,509,468 B2 8/2013 van Halteren
8,526,651 B2 9/2013 Lafort
8,526,652 B2 9/2013 Ambrose
8,625,809 B2 1/2014 Josefsson
8,630,429 B2 1/2014 Daley
8,873,773 B2 10/2014 Akino
9,148,729 B2 * 9/2015 Josefsson ..... H04R 3/06
9,197,967 B2 11/2015 Mortensen
9,300,259 B2 3/2016 Frohlich
9,716,945 B2 * 7/2017 Lesso ..... H04R 3/06
9,781,518 B2 10/2017 Schober
2002/0125949 A1 9/2002 Stenberg
2004/0179703 A1 9/2004 Boor
2007/0160234 A1 7/2007 Deruginsky
2008/0025531 A1 1/2008 Suzuki
2008/0205668 A1 8/2008 Torii
2009/0003629 A1 * 1/2009 Shajaan ..... H04R 1/005 381/113
2010/0166228 A1 * 7/2010 Steele ..... A61B 8/4444 381/113
2010/0246859 A1 9/2010 Filippo
2010/0329487 A1 * 12/2010 David ..... H03F 3/187 381/174
2011/0182453 A1 7/2011 van Hal
2011/0189880 A1 8/2011 Bondo
2011/0299708 A1 12/2011 Bondo
2011/0299712 A1 12/2011 Bondo
2011/0311069 A1 12/2011 Ambrose
2012/0014548 A1 1/2012 van Halteren
2012/0027245 A1 2/2012 van Halteren
2012/0140966 A1 6/2012 Mocking
2012/0155683 A1 6/2012 van Halteren
2012/0155694 A1 6/2012 Reeuwijk
2012/0206205 A1 8/2012 Hoogzaad
2012/0255805 A1 10/2012 van Halteren
2012/0269367 A1 10/2012 Akino
2013/0028451 A1 1/2013 de Roo
2013/0051582 A1 2/2013 Kropfitsch
2013/0129117 A1 * 5/2013 Thomsen ..... H04R 3/00 381/111
2013/0136284 A1 5/2013 van Hal
2013/0142370 A1 6/2013 Engbert
2013/0163799 A1 6/2013 Van Halteren
2013/0195291 A1 * 8/2013 Josefsson ..... H02M 1/12 381/174
2013/0195295 A1 8/2013 van Halteren
2014/0003609 A1 * 1/2014 Rombach ..... H04R 3/00 381/58
2014/0037121 A1 2/2014 Mortensen
2014/0086433 A1 * 3/2014 Josefsson ..... H04R 3/06 381/98
2014/0264652 A1 * 9/2014 Cagdaser ..... H04R 19/04 257/416
2015/0023529 A1 * 1/2015 Barzen ..... G01R 27/2605 381/174
2015/0137834 A1 5/2015 Steiner
2015/0181352 A1 * 6/2015 Astgimath ..... H04R 3/00 381/174
2015/0245143 A1 * 8/2015 Akino ..... H04R 19/016 381/174
2016/0337753 A1 * 11/2016 Akino ..... H04R 19/04
2016/0352294 A1 * 12/2016 Nicollini ..... H03F 3/45076
2017/0180858 A1 * 6/2017 Kidambi ..... H04R 3/06
2017/0195788 A1 * 7/2017 Nicollini ..... H04R 3/007
2017/0223450 A1 * 8/2017 Paton Alvarez ..... H03F 1/0211
2018/0014123 A1 * 1/2018 Shajaan ..... H04R 3/02
2018/0027338 A1 * 1/2018 Shajaan ..... H04R 19/04
2018/0143068 A1 5/2018 Lafort

FOREIGN PATENT DOCUMENTS

EP 2978241 A1 1/2016
EP 1906704 A1 4/2018
JP 2006-295357 A 10/2006
WO WO 01/78446 A1 10/2001
WO WO 2013/167183 A1 11/2003
WO WO 2012/148077 A3 11/2012

OTHER PUBLICATIONS

Extended European Search Report in European Patent Application No. EP 16199657, dated Apr. 11, 2017 (3 pages).

(56) References Cited

OTHER PUBLICATIONS

Extended European Search Report in European Patent Application No. EP 16199644, dated May 10, 2017 (3 pages).
Extended European Search Report in European Patent Application No. EP 16199653, dated May 11, 2017 (3 pages).
Pedersen M. et al., "High-Performance Condenser Microphone with Fully Integrated CMOS Amplifier and DC-DC Voltage Converter," Journal of Microelectromechanical Systems, vol. 7, No. 4, Dec. 1998, pp. 387-394 (8 pages).
Extended European Search Report in European Patent Application No. EP17202253, dated Mar. 15, 2018 (3 pages).
Extended European Search Report in European Patent Application No. EP 17202256, dated Mar. 21, 2018 (3 pages).
Extended European Search Report in European Patent Application No. EP 17202265, dated Apr. 10, 2018 (3 pages).
Anonymous; "Q. Are back-electret mics any good?"; Sound on Sound; Aug. 3, 2016; XP055535410; retrieved from the Internet: https://web.archive.org/web/20160803061346/https://www.soundonsound.com/sound-advice/q-are-back-electret-mics-any-good (3 pages).

* cited by examiner

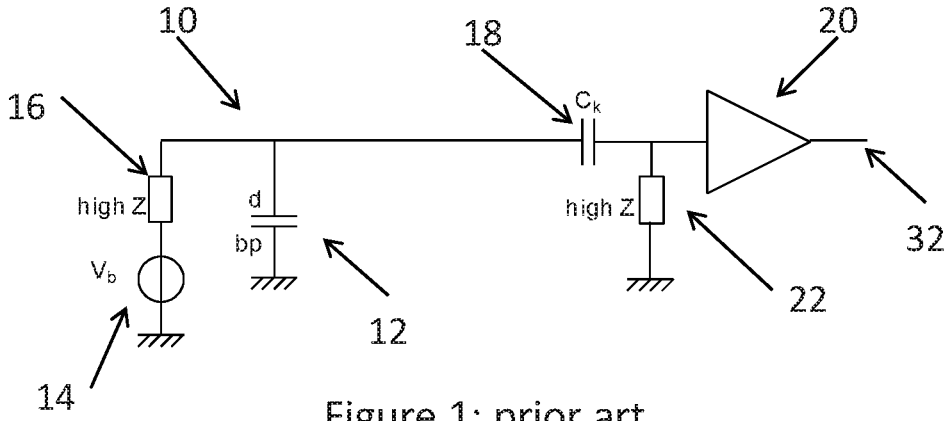
Figure 1; prior art
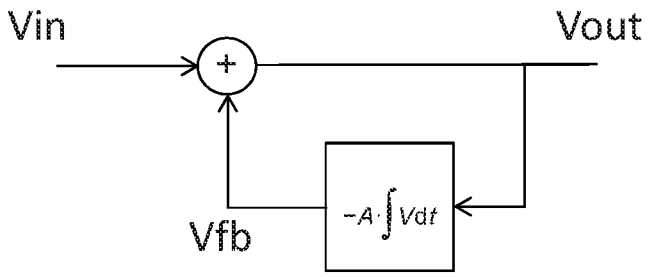
Figure 2
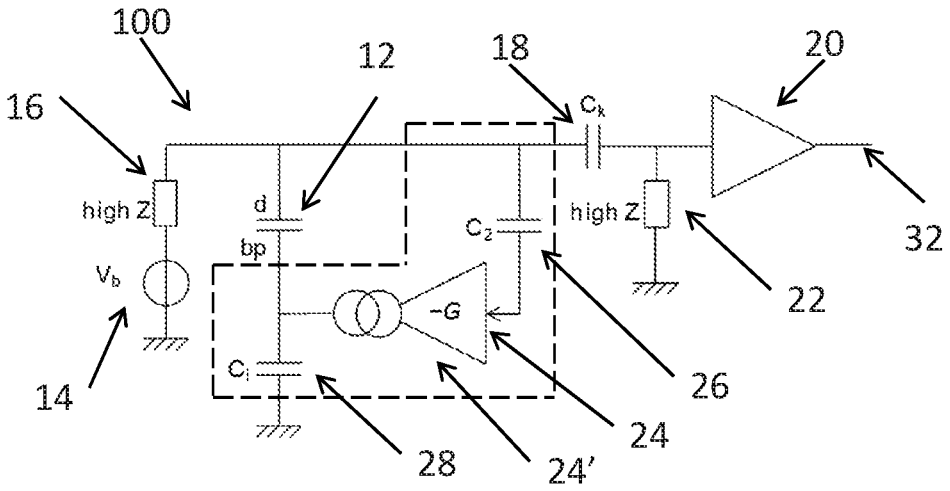
Figure 3

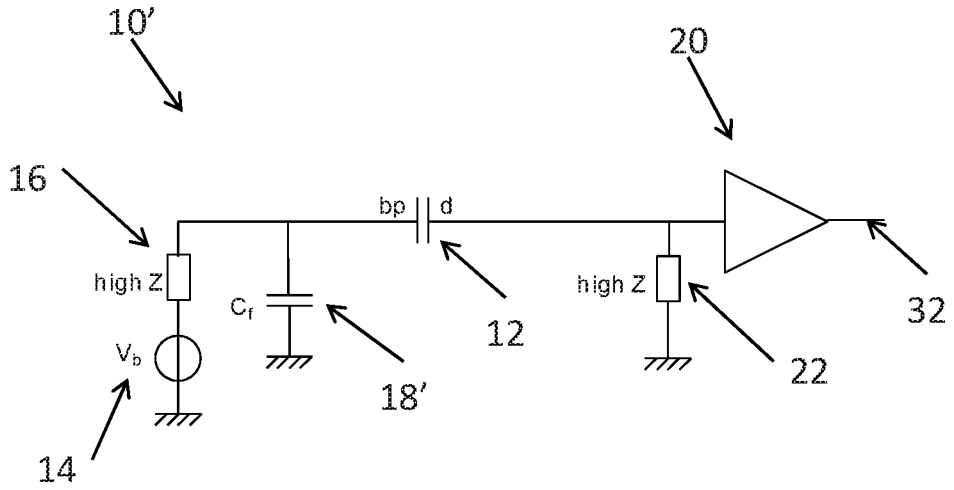
Figure 4; prior art
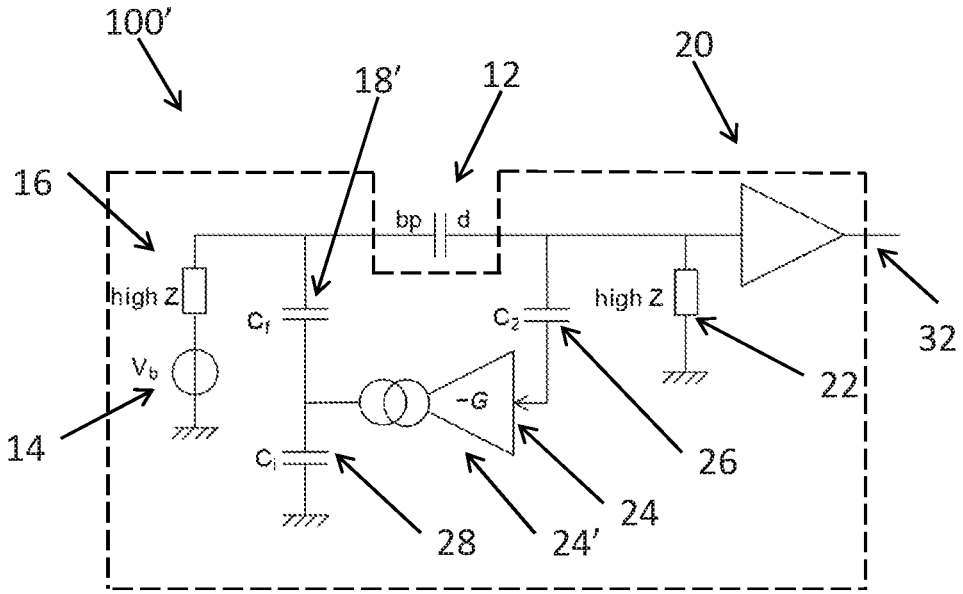
Figure 5

PHASE CORRECTING SYSTEM AND A PHASE CORRECTABLE TRANSDUCER SYSTEM

CROSS-REFERENCE TO RELATED APPLICATIONS

This application claims the benefit of European Patent Application Serial No. 16199657.4, filed Nov. 18, 2016, which is incorporated herein by reference in its entirety.

FIELD OF THE INVENTION

The present invention relates to a system for correcting the phase of an output of a transducer connected to the phase correcting system. Phase adaptation of transducers is desired in e.g. in directional microphones or sensor arrays where it is desired that the microphones/sensors have the same phase characteristics.

BACKGROUND OF THE INVENTION

Due to production variances, the exact low-frequency corner of a microphone sensor is subject to variance. As a consequence, the phase response at low frequency is also subject to variance. E.g. if the LF-corner varies between 40 and 60 Hz, the phase response at 200 Hz varies between 11.3 and 16.7 deg. For acceptable beamforming however, the phase difference between the microphones of a matched pair with 12 mm port distance should be smaller than 2 degrees at 200 Hz; for accurate beamforming the phase difference should be smaller than 0.5 degrees. In some cases with smaller port spacing (e.g. on a faceplate) the requirement is 0.36 degrees at 170 Hz.

Currently, the phase difference between microphones is guaranteed by selection (to create matched pairs) or by sorting (to create arrays of microphones). The production and further assembly of these microphones requires careful handling in order not to alter the correct sequence.

Different solutions in this area may be seen in U.S. Pat. No. 6,914,992, US2004/179703, US2015/0137834, US2004/0179703, U.S. Pat. No. 9,148,729, US2015/0245143, US2014/0086433, US2016/0337753, US2014/0264652 and U.S. Pat. No. 8,170,237.

A first aspect, the invention relates to a phase correcting system comprising:

- a first input terminal and a second input terminal both being configured to be connected to terminals of a transducer,
- a first transport element configured to receive a signal from the first input terminal and feed a corresponding signal to an output terminal, and
- a feedback element having:
- a feedback entry conductor connected to the first transport element,
- a feedback exit conductor connected to the second input terminal and
- a circuit configured to receive a first signal from the feedback entry conductor and output, on the feedback exit conductor, a second signal as a low pass filtered first signal, the circuit having a variable cut-off frequency of the low pass filtering.

SUMMARY OF INVENTION

In the present context, the system may be made of a single chip, circuit, element or the like, such as a DSP, ASIC, FPGA, processor or the like. Alternatively, the system may be made of a number of separate elements communicating with each other. The system is able to affect a transducer, when connected to the input terminals of the system.

In this connection, an input terminal and/or an output terminal may be an electrically conducting element. Often, a terminal is an element, such as a pad, to which a conductor of e.g. a transducer may be attached, such as by soldering, gluing, press fitting or the like.

It is noted that an input/output terminal may not necessarily be configured to only receive a signal. Electrical signals may be forwarded in both directions via an input/output terminal.

A transducer is an element configured to sense or detect a parameter of the transducer or its surroundings, such as vibration or sound. Often, the transducer will have a stationary element and a movable element and will output a signal corresponding to a variation of a distance between the movable element and the stationary element. In this respect, corresponding often means that the frequency contents of the output signal, at least within a predetermined frequency interval, corresponds to that of the parameter detected.

Often, a transducer is an element configured to sense movement of a movable element in relation to one or more stationary element(s). Naturally, it is of no importance which element moves in relation to another element. The distance/position variation between the movable element and the stationary element(s) will cause an output signal on the transducer output.

Naturally, which element is stationary and which is movable will depend on in which coordinate system one views the system. In many situations, the movable element is more resilient and bendable, for example, than the stationary element, so that the stationary element is stationary in relation to a remainder, such as a housing, of the transducer. Naturally, multiple movable elements may be used in addition to or instead of a movable element and a stationary element. Also, multiple stationary elements may be used together with the one or more movable elements.

Any number of stationary elements may be provided. Often one or two stationary elements are provided in situations where the movable element is a plane element, where the stationary element(s) is/are also plane element(s) provided parallel to the movable element in a desired distance so that the movable element may move while being in a vicinity of the stationary element(s). Transducers of this type may be microphones, where the movable element may then be a diaphragm.

The transducer has at least two transducer terminals. The output signal is normally output as a difference in voltage between two terminals. Thus, the output may be seen as derived from one of the terminals, if the other is kept at a predetermined, fixed voltage, such as ground. A terminal may simply be a conductive element.

One type of transducer is a capacitive transducer which is an electro-acoustical or electro-mechanical transducer, the capacitance of which varies with the parameter sensed. An electrical field may be generated in the transducer by biasing two elements therein (providing a voltage between the elements) and/or by permanently charging an element. When that or another element moves within that field, an output signal may be derived which relates to the change in capacitance due to this movement.

The biasing voltage may be provided between two of the movable element and the stationary element(s). If a single stationary element is provided, the first voltage is provided between the stationary element and the movable element. If two stationary elements are provided, the voltage may be provided between the stationary elements or between one stationary element and the movable element. Naturally, different voltages may be provided to all of the stationary elements and the movable element.

Multiple movable elements may also be provided if desired, where any additional movable element may also receive a voltage or output a signal.

An output of the transducer may be derived from any one or more of the stationary element(s) and the movable element. Usually, the output of the transceiver will depend on the movement or position of the movable element in relation to the stationary element(s).

The first transport element is configured to receive a signal from the first input terminal and feed a corresponding signal to an output terminal. The output terminal may be of the same type as the input terminals, such as merely a conductor.

The transport element may simply be a conductor, or it may comprise components for altering the signal received on the first input before outputting the corresponding signal. In one embodiment, any components of the transport element are passive, i.e. require no separate power supply.

In this context, a signal corresponding thereto may be a signal which has at least the same or similar frequency contents at least within a predetermined frequency interval. The corresponding signal may be filtered, amplified, attenuated or the like. Also, the corresponding signal may be provided on another DC voltage level, such as if the transport element comprises a capacitor.

Usually, a feedback element is an element deriving a signal at one position along a signal path and introduces another signal at an earlier position of the signal path.

The feedback element has an entry conductor for receiving a signal, a circuit for receiving a first signal, such as directly from the entry conductor, and outputting a second signal as a low pass filtered version of the first signal, and an exit conductor for outputting the resulting signal from the feedback element.

The circuit is configured to output the second signal as a low pass filtered first signal. Low pass filters have the property of not only attenuating frequency contents higher than a cut-off frequency but also phase shifting the low pass filtered signal. Feeding a low pass filtered signal back to a transducer will have the effect of affecting the phase of the signal output thereof.

Then, the phase of such a signal may be varied or adapted if a parameter, such as the cut-off frequency, of the low pass filter is variable.

It may be desired to provide a filtering with a cut-off frequency below a desired frequency interval of the transducer, as the resulting effect of feeding the low pass filtered signal to the transducer is a high-pass filtering of the signal out of the transducer. This cut-off frequency often is the frequency at which the signal strength (intensity) is −3 dB (half) of that at a predetermined frequency, such as 1000 Hz. Preferably, for sound applications, the cut-off frequency is 200 Hz or lower, such as 150 Hz or lower, such as 100 Hz or lower, such as 50 Hz or lower, such as 40 Hz or lower, such as 30 Hz or lower.

The cut-off frequency may also be derived from a lower cut-off frequency of a transducer to which the present system is connected or adapted. The cut-off frequency than may be between a factor of 5, such as a factor of 4, lower than the transducer cut-off and a factor of 5, such as a factor of 4, such as a factor of 3, such as a factor of 2, higher than the transducer cut-off frequency.

Naturally, further electronic components may be provided in the feedback element, such as between the entry conductor and the circuit and/or between the circuit and the exit conductor. One such component may be a capacitor operating as a DC decoupling. Also, resistors, high impedance circuits, diodes, transistors or the like may be provided for generating the first signal fed into the circuit.

The circuit may be an integral part of the system or may be a separate portion thereof. The circuit has a low pass filtering function which is adaptable and which may be embodied in multiple manners.

In this connection, the second signal is proportional with the low pass filtered first signal, even if a DC-component may be removed, an integration constant may be applied, and/or linear gain or attenuation may be applied.

The second signal may additionally be a time-integration of the first signal, or the second signal may be additionally altered. In this context, a time-integration of a signal may be an integration of the signal value, such as a current or a voltage, over time. The integration may be over a predetermined period of time, since a well-defined point in time or an in-determined period of time, such from a starting point in time of operation of the system to the current point in time.

In general, the signals may be voltages.

The feedback entry conductor is connected to the first transport element. Then, the feedback element may be fully provided inside the system. As mentioned above, the transport element may simply be a conductor, whereby any position thereof may be connected to the feedback entry conductor. However, the transport element may comprise electrical components and thereby provide a number of different positions for connection with the entry conductor. One desirable position for connecting the entry conductor is the first input terminal. Another position is the output terminal. Positions between components of the transport element may also be used, such as between a DC decoupling capacitor and an amplifier of the transport element.

In addition, the system may comprise additional feedback loops such as that seen in the Applicants co-pending application with the title "AN ASSEMBLY AND AN AMPLIFIER FOR USE IN THE ASSEMBLY" filed on even date and claiming priority from EP16199655.8, and which is hereby incorporated herein by reference in its entirety.

As mentioned above, the first transport element may comprise a capacitor. This capacitor may act to decouple one DC level present on the first input terminal and another DC level on the output terminal or of one or more components provided between the capacitor and the output terminal or elements connected to the output terminal. To this effect, the capacitor may be dimensioned in relation to a capacitance of a particular transducer, such as at least 2, such as at least 4, such as at least 6, such as at least 8 times the capacitance of the transducer.

In one embodiment, the first transport element comprises an amplifier. An amplifier may be used for amplifying the signal to be output on the output terminal and/or for adapting an output impedance of the system.

An amplifier is an element which is configured to receive an input signal and output an output signal where the intensity (voltage/current or the like) of the output signal has been amplified. In this respect, an amplification may be higher than 1, so that the intensity output is higher than that received, or lower than 1, whereby the intensity output is lower than that received. An amplification of 1 outputs the same intensity. This may be desired for other purposes, such as for altering the apparent impedance of a circuit receiving the output of the amplifier compared to the component feeding the signal to the amplifier. The amplification may also be negative, whereby the polarization of the signal output of the amplifier is the opposite of that received.

Naturally, an amplifier may have multiple inputs. Often, when a single input is described, any additional inputs may be provided with predetermined signals or voltages, such as ground.

The feedback exit conductor is connected to the second input terminal. In one embodiment, no other components of the system are connected to the second input terminal. In another embodiment, a capacitor is connected between the feedback exit conductor or second input terminal and a predetermined voltage.

As mentioned above and described further below, the overall effect of the feedback element may be to high pass filter a signal otherwise output of a transducer to the first input terminal. The cut-off frequency of this filter preferably is defined away from, typically below, the frequency interval of interest, such as the audible range of hearing impaired persons.

In one embodiment, the circuit comprises a converting element configured to convert a received voltage into an output current. Naturally, this converting element may be connected directly between the entry and exit conductors to form the only element of the feedback element. Alternatively, as described above, additional components may be provided.

The advantage of voltage to current conversion as a first step is that time integration of the current to a voltage is quite simple using a capacitor.

In one embodiment, this converting element is a transconductance amplifier. Adapting the transconductance of this amplifier will facilitate adaptation of the phase of a signal output of a transducer connected to the input terminals.

In one embodiment, the circuit comprises an amplifier, preferably with a negative gain, and a resistor. In this situation, the gain and/or resistance may be varied to vary a phase of a signal output of a transducer connected to the input terminals.

Other types of circuits for use in the feedback element are switched capacitor integrators (which are switched by a clock preferably with a frequency above a frequency interval of interest from the transducer—and may be controlled by varying the switching frequency or by changing capacitor ratios) and an operational amplifier integrator (which may be controlled by altering the resistance and/or capacitance thereof).

Naturally, any type of transducer may be used in connection with the present system. Often, transducers for microphones or vibration sensing are capacitive sensors and often sensors which receive a biasing voltage.

This biasing voltage may be provided directly to the transducer outside of the system, but it may be desired to have as few building blocks as possible and thus to further provide in the system a first voltage supply connected to output a first voltage to the first or the second input terminal. When the voltage is provided to the first input terminal, the first transport element preferably comprises a first capacitor. This capacitor may be to decouple the DC level at the first input terminal and a DC level at the output terminal or components between the capacitor and the output terminal. Also, it may be desired to provide a DC decoupling capacitor between the first input terminal and the entry conductor or between the entry conductor and a component/circuit of the feedback element.

As mentioned, the feedback entry conductor may be connected to the first transport element between the first capacitor and the output terminal.

In one embodiment, as mentioned, the feedback entry conductor is connected to the first transport element between the first input terminal and the first capacitor, where the feedback element comprises a second capacitor between the feedback entry conductor and the circuit.

In general, it is preferred that the feedback element, such as the circuit thereof, is variable to vary a phase of a signal received on the first input terminal, when a transducer is connected to the first and second terminals.

In general, the system may further comprise a filter adjusting input connected to the feedback element and/or the circuit for receiving an adjustment signal adjusting the circuit, such as the cut-off frequency. As described above, this may be in order to vary a transconductance of a transconductance amplifier, the gain of an amplifier, the cut-off frequency of a filter, the capacitance of a capacitor, the resistance of a resistor or the like.

A second aspect of the invention relates to a transducer system comprising:

a transducer having a first and a second transducer terminal, a system according to the first aspect, wherein the first transducer terminal is connected to the first input terminal and the second transducer terminal is connected to the second input terminal.

Naturally, all the above embodiments and considerations of the first aspect are equally relevant in relation this aspect of the invention.

In one embodiment, the transducer system further comprises an amplifier having an amplifier input connected to the output terminal, Thus, this amplifier is external to the system according to the first aspect.

As described, the transducer system may further comprise a first voltage supply configured to output a first voltage to the first or second transducer terminal. This voltage supply may be external or internal to the system according to the first aspect.

Having now connected a transducer to the above system, variation of the feedback element will cause the phase of the signal fed from the transducer to the first input terminal to vary.

It is noted that the feedback element may be provided in the system according to the first aspect, whereby the phase may be adapted in the signal even before reaching any external amplifier.

Thus, a third aspect of the invention relates to an assembly of transducer systems according to the second aspect of the invention, wherein each transducer system has a filter adjusting input connected to the circuit for receiving an adjustment signal adjusting the cut-off frequency and where each transducer system receives a different adjustment signal on the filter adjusting input. In that manner, the transducer systems of the assembly may be individually corrected to a desired phase response, such as a phase response of one transducer.

BRIEF DESCRIPTION OF THE DRAWINGS

In the following, preferred embodiments of the invention are described with reference to the drawing, wherein:

FIG. 1 illustrates a prior art system with a transducer and an amplifier where no phase correction is made, FIG. 2 illustrates the general principle of phase adjustment of a signal, FIG. 3 illustrates a first embodiment according to the invention with a biased transducer as seen in FIG. 1 but with a feed-back from one terminal of the transducer to the other terminal, FIG. 4 illustrates another prior art system with a transducer and an amplifier where no phase correction is made, FIG. 5 illustrates a second embodiment according to the invention with a biased transducer as seen in FIG. 4 but with a feed-back from one terminal of the transducer to the other terminal.

DETAILED DESCRIPTION OF THE INVENTION

Figure 6:
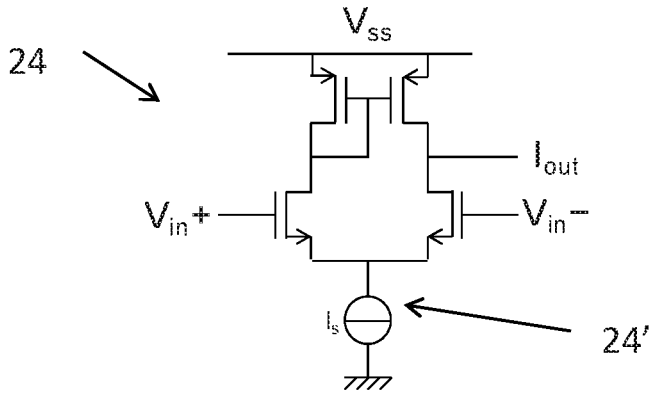
FIG. 6 illustrates an embodiment of a transconductance amplifier as used in FIGS. 3 and 5, FIG. 7, which is not according to the invention, illustrates feedback from after an amplifier and using a generic circuit.

In FIG. 1, the usual system 10 is illustrated wherein a capacitive transducer 12 is biased by a charge pump 14. The biasing voltage is supplied via a high impedance circuit 16, which often is a pair of anti-parallel diodes 16. The diaphragm, d, is connected to an input of an amplifier 20 via a DC decoupling capacitor 18. The desired operation of the capacitor 18 is to transfer the varying signal from the transducer without creating a DC connection between the transducer and the remainder of the circuit, as this could disturb the operation of the buffer amplifier 20. Thus, in order not to attenuate the signal from the transducer, the capacitor preferably has a value being sufficiently high. At present, the capacitor 18 is at least 2, such as at least 4, such as at least 6, such as at least 8 times the capacitance of the transducer.

Also provided is a second high impedance circuit 22, also typically a pair of anti-parallel diodes providing a DC path to a predetermined voltage, in this example to ground, were the voltage level is such that amplifier 20 can operate over a large voltage range. The amplifier outputs the amplified signal on an output 32.

In order to be able to correct the phase of the signal output of the system 10, naturally the phase of the output of the amplifier 20 may be adapted.

However, according to the invention, the phase of the output of the transducer 12 is adapted by feeding back a signal to a terminal of the transducer 12.

In FIG. 2 the principle of the phase correction circuit is shown.

The output signal ($V_{out}$) is the result of the summation of an input signal ($V_{in}$) and a time-integrated version of the same output signal ($V_{fb}$). The integration constant is −A.

In the frequency domain, the time-integrated output signal is expressed as:

$$V_{fb}=V_{out}\cdot A/2\pi f$$

So that:

$$V_{out} = V_{in} - V_{out} \cdot A/2\pi f$$

and:

-continued $$V_{out} = V_{in} \cdot \frac{1}{1 + A/2\pi f}$$

$$V_{out} = V_{in} \cdot \frac{1}{1 + A/2\pi f} = V_{in} \cdot \frac{2\pi f/A}{1 + 2\pi f/A}$$

which is a high-pass filtered version of the input signal with cut-off frequency A.

So the feedback signal equals $$V_{fb} = -V_{in} \cdot \frac{1}{1 + 2\pi f/A}$$

which effectively equals a loss-less filtered version of the input signal with cut-off frequency A.

By adjusting the value of A, we adjust the cut-off frequency, and thus the phase of both the feedback signal, and the output signal of the summation.

Figure 8:
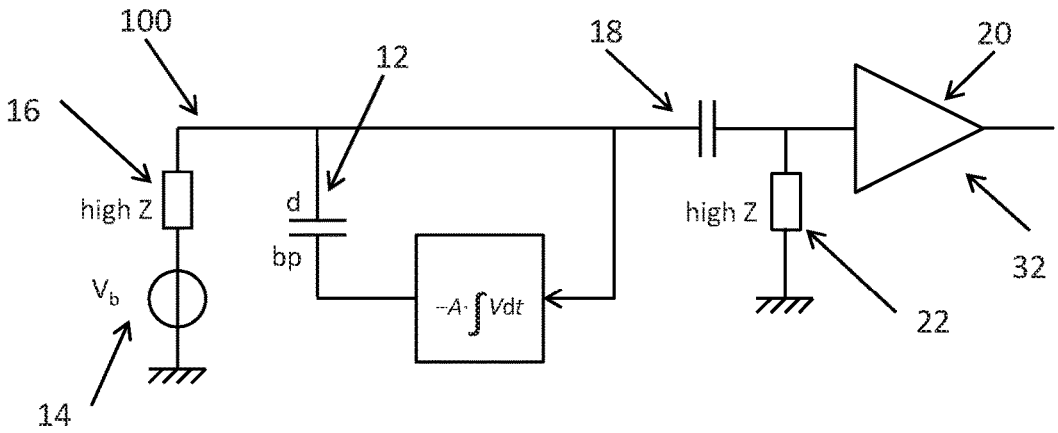
FIG. 8 illustrates feedback from the first input terminal using the generic circuit.

In FIG. 8, a generic system is illustrated with a transducer 12, in this example biased as seen in FIG. 1, and feeding a signal to the amplifier 20 via a capacitor 18. A time integrating feedback loop is provided deriving the signal from the transducer output (upper terminal) and feeding back a signal to the other transducer terminal (the lower one).

In FIG. 3, a system 100 is illustrated with a transducer 12, biased as in FIG. 1 and feeding a signal to the amplifier 20. The components 18 and 22 are still provided as the transducer 12 is biased.

A first embodiment of a feedback circuit is provided comprising a second capacitor 26 and a transconductance amplifier 24. This circuit receives a signal from the upper terminal (diaphragm d) of the transducer and feeds a signal to the lower terminal (the back plate bp). A third capacitor 28 is provided between the back plate and ground in order to integrate the output current from amplifier 24, and feed the resulting voltage back to the lower terminal of the transducer.

The capacitor 26 has the same function as the capacitor 18, i.e. to provide a DC decoupling of the diaphragm and the amplifiers 20/24 while transmitting preferably all frequencies output by the transducer 12.

The operation of the feedback circuit is that a voltage received by the amplifier 24 is converted into a current which is fed to the connection between the capacitor 28 and the lower transducer terminal, here in the form of the backplate. The conversion factor of the transconductance amplifier is G, often expressed in A/V, mA/V, uA/V.

The integrating feedback path is formed by transconductance G and capacitance Ci. The integration constant $A=G/(2\pi C_i)$. This means that the LF cut-off frequency also equals $G/(2\pi C_i)$. For example, using a practical value for Ci of 80 pF, the transconductance G should be programmable in the range of 5 to 15 nA/V in order to obtain a programmable cut-off frequency of 10 Hz to 30 Hz.

An input 24' is provided for receiving an input programming the amplifier 24 to the correct phase output of the transducer 12, the capacitor 18 or the amplifier 20.

In general, low pass filters have the function, in addition to the frequency filtering, of changing the phase of the filtered response compared to the signal to be filtered. Thus, the filter characteristics may be adapted in order to vary the phase of the filtered signal, which is fed back to the transducer. Thus, the overall phase of the output of the transducer is adapted.

Then, no additional phase correcting elements need be added to obtain a desired phase output of the amplifier 20 and thus the system 100.

In general, the transconductance amplifier 24 may be a power consuming element requiring a power supply. Usually, for amplifiers, the output thereof is limited by the power supply, so that the voltages supplied to the amplifier 24 preferably define there between the voltages expected on the input of the amplifier. As biased transducers 12 are often supplied with higher voltages than other components, such as the amplifier 20, it may be desired to supply the amplifier 24 with the voltage from the supply 14. Naturally, the other voltage (often of an opposite polarization than that from the supply 14) supplied to the amplifier 24 may be derived using a DC/DC voltage converter.

This transconductance amplifier 24 may be replaced. The same operation may be obtained or approximated using an inverting amplifier (for example an operational amplifier) with a relatively large series resistance in the output. The limitation of such approximation is that there will be a voltage drop across that resistor, so that in order to obtain a certain voltage swing at the output (i.e. behind the resistor) the voltage swing of the amplifier should be larger (and thus its supply voltage). The replacement comprises an amplifier (voltage to voltage), a series resistor and a capacitor (already drawn at the output of the transconductance amp). With an amplifier voltage gain of −1, the series resistance should be 1/G in order to obtain the same cut-off frequency using a capacitor Ci.

Figure 9:
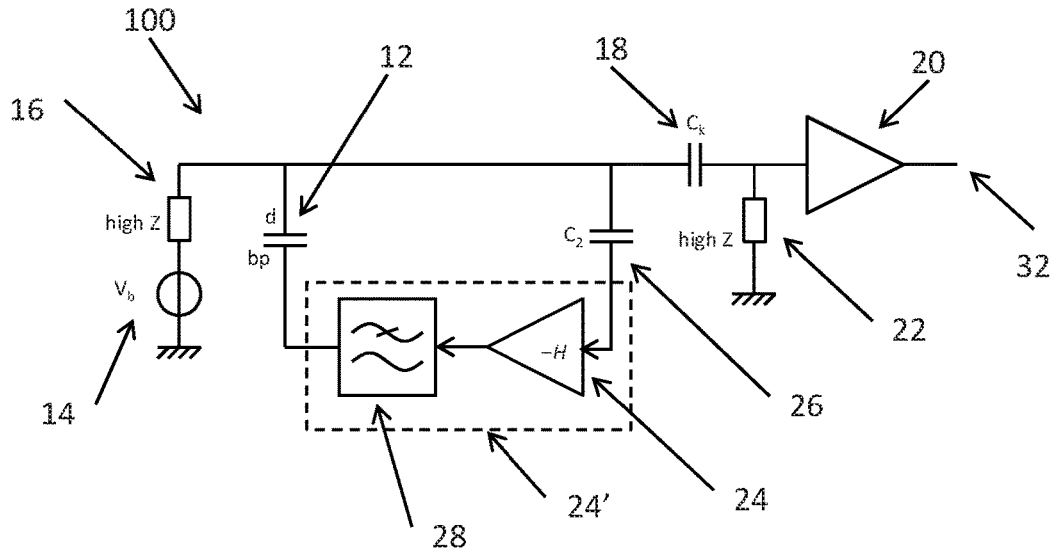
FIG. 9 illustrates feedback using an amplifier and a low pass filter and FIG. 10 illustrates the effect of the present invention in a particular example.

In FIG. 9, this is illustrated where the feedback loop has an amplifier with a negative gain and a low pass filter.

Naturally, the present system may be divided into different building groups. Often, the transducer 12 is provided separately, and it is desired to provide the supply thereof and/or signal treatment or amplification in one or more other building blocks.

In FIG. 3, a building block, which may generally be a single chip, is illustrated comprising the feedback amplifier 24 and the capacitors 26/28. Thus, this block may be provided if desired, and the input 24' may be used for adapting the low pass filtering and/or phase of the signal output of this block and/or the subsequent components, such as the capacitor 18 and the amplifier 20. In some situations, the capacitor 28 may be desired to not be in a building block due to e.g. its size.

Alternatively, the feedback may be derived after the capacitor 18. Still, the capacitor 26 may be preferred, such as if the transconductance amplifier 24 and the amplifier 20 are on different voltage levels.

The inputs/outputs of such building blocks usually are connection pads or terminals to which other elements may be connected, such as by soldering, gluing, welding, press fitting or the like.

It is interesting to note that this system has a phase adaptable before the amplifier 20. Thus, an assembly of such systems may be provided which, via the controlling on the input 24' may have the same phase output on the outputs. Then, no physical matching of transducers (pairing transducers which from manufacture have nearly identical phases) is needed, nor is circuitry provided after the amplifier in order match the phase of one system with that of another.

In FIG. 4, another prior art system 10' is seen which to a large degree resembles that of FIG. 1 but where the back plate bp is biased by the biasing components 14/16 but where the diaphragm still outputs the output but now directly to the amplifier input. A capacitor 18' is now is provided for filtering away noise generated by the charge pump 14.

In FIG. 5, a corresponding system 100' is illustrated now comprising the feedback circuit with the capacitor 26 and the transconductance amplifier 24—and again the capacitor 28 is provided. Now, the capacitor 18' is used also for DC decoupling the feedback amplifier 24 from the biased back plate.

In FIG. 5, another splitting up of the system into building blocks is seen, where all but the transducer 12 is a single block. Thus, this building block comprises both the biasing components 14/16/18 and the amplifier 20, so that once the transducer 12 is attached to the input terminals of this circuit, the output terminal will be an amplified signal with an adaptable (via the input 24') phase.

Figure 7:
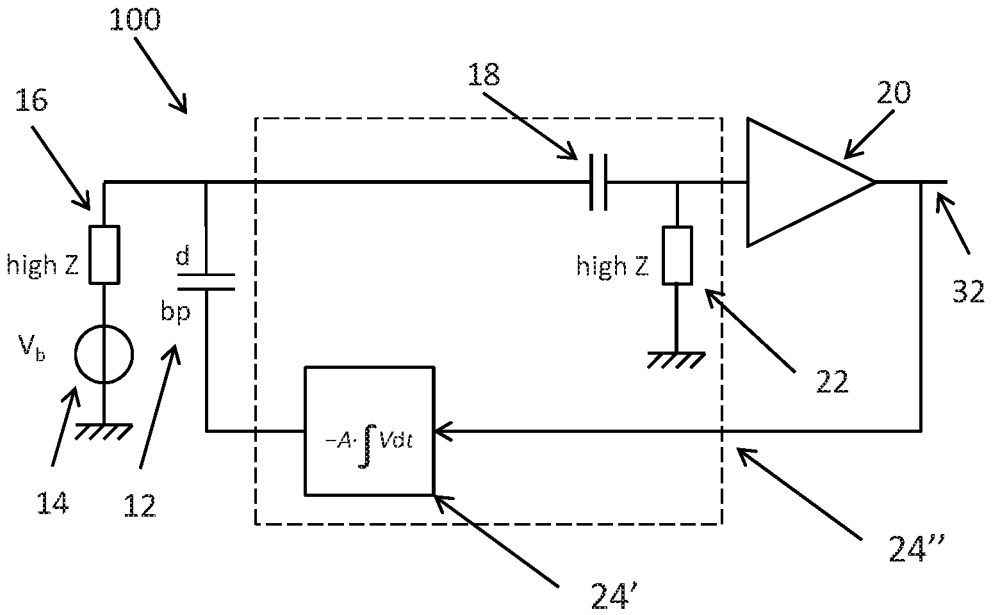

Clearly, the feedback loop may be connected anywhere between the signal output of the transducer and the amplifier input. In FIG. 7, an alternative embodiment is illustrated where the feedback is derived from the signal output of the amplifier 20. The other components are maintained the same as before to highlight this difference. Thus, the output of the amplifier is time integrated and fed to the other (not signal outputting) terminal of the transducer 12.

FIG. 6 illustrates a possible implementation for the transconductance amplifier of FIGS. 3 and 5.

The input of the transconductance amplifier is seen at Vss and the output at Iout.

The Vin+ input should be connected to a reference voltage, and a suitable DC feedback path should be included for the Vin− input in order to work in a proper operating point.

The transconductance can be controlled by means of a programmable bias current (Is). For a value of G in the range of 5 to 15 nA/V, Is should be in the order of magnitude of 1 to 10 nA. This current may be provided on the input 24'.

Since the current consumption of the transconductance amplifier is so small, it can easily be supplied from the same source as the MEMS bias 14, as described above, which is usually higher than the supply voltage of the microphone. The bias voltage is usually generated by means of a charge pump. The advantage of supplying the transconductance amplifier with the bias voltage is the larger maximum output voltage swing, so that the functionality of the feedback loop is not limited by the supply voltage. This is also the reason why the input of the transconductance amplifier is not connected to the output of the buffer amplifier. In the figure, the input of the transconductance amplifier is coupled capacitively to the diaphragm terminal of the MEMS.

Figure 10:
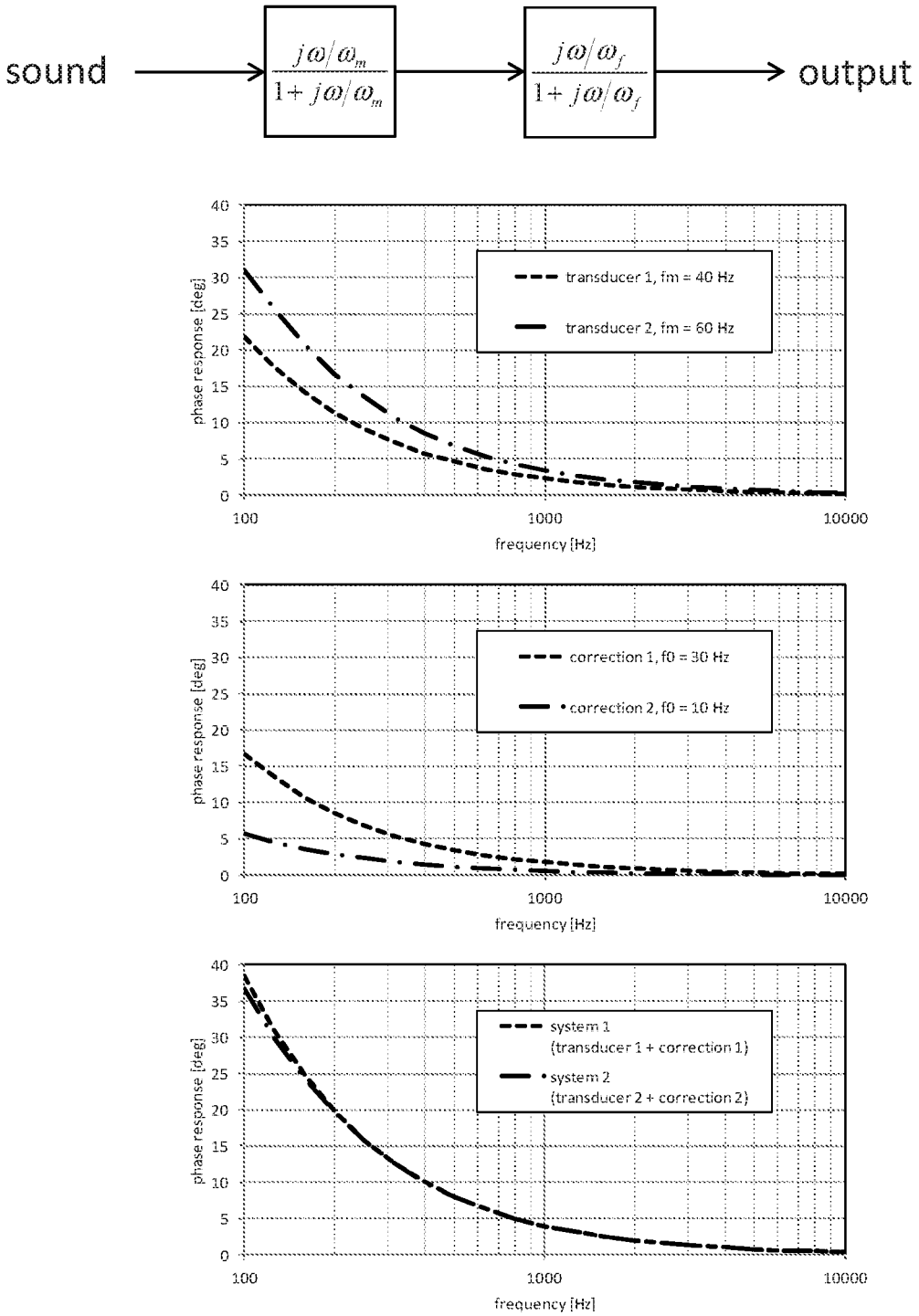

In FIG. 10, the effect of the present invention is illustrated. As mentioned, the time integration generates a programmable electrical high-pass filter to the signal output of the transducer (low pass filtered output back to the transducer) which corrects the phase spread of the transducer which in this situation is a microphone sensor. At the top of FIG. 10, the output of the transducer is seen as well as the high pass filtered output of the transducer with phase correction function when the feedback is active.

In this example, two transducers (transducer 1 and transducer 2) are selected which are supposed to be the same but which due to production imperfections have different low frequency cutoffs (−3 dB compared to the response at a reference frequency of e.g. 1 kHz). The phase response at 200 Hz of the transducer varies between 11.3 and 16.7 degrees as seen in the upper graph of FIG. 10.

The programmable filter can be used to trim the phase response at 200 Hz of all microphones/transducers to e.g. 20 degrees by adding between 3.3 and 8.6 degrees phase shift.

This would require a high pass filter of which the cut-off frequency is trimmable between 11.5 and 30.5 Hz.

The phase response at 200 Hz is given by $$\varphi_{200} = \arctan\frac{f_m}{200} + \arctan\frac{f_c}{200},$$

where fm is the low frequency cut-off frequency of the transducer, and fc is the cut-off frequency of the phase correction function.

The upper graph of FIG. 10 illustrates the minimum and maximum phase response of the two microphone sensors without feedback.

The middle graph of FIG. 10 illustrates the minimum and maximum phase response of the high pass function (generated by the feedback) for the phase correction and the lower graphs illustrate the effect, as the phase responses of the two sensors are now virtually identical.

This means a spread in microphone sensor LF cut-off frequency of e.g. 50±10 Hz can be compensated by a programmable filter in the range of e.g. 20±10 Hz. The maximum microphone phase spread in this example of 5.4 degrees at 200 Hz can be reduced to less than 0.3 degrees if the filter can be programmed is steps smaller than 1 Hz.

The present embodiments may be combined with a number of other advantageous improvements of systems, such as the Applicants co-pending applications filed on even date and with the titles: "A CIRCUIT FOR PROVIDING A HIGH AND A LOW IMPEDANCE AND A SYSTEM COMPRISING THE CIRCUIT", claiming priority from EP16199644.2, "A TRANSDUCER WITH A HIGH SENSITIVITY", claiming priority from EP16199651.7, and "A SENSING CIRCUIT COMPRISING AN AMPLIFYING CIRCUIT AND THE AMPLIFYING CIRCUIT", claiming priority from EP16199653.3. These references are hereby incorporated herein by reference in their entireties.

The invention claimed is:

1. An assembly of transducer systems, each comprising a transducer having a first and a second transducer terminal, and a system comprising:

a first input terminal, connected to the first transducer terminal, and a second input terminal, connected to the second transducer terminal, a first transport element configured to receive a signal from the first input terminal and feed a corresponding signal to an output terminal, and a feedback element having:

a feedback entry conductor connected to the first transport element, a feedback exit conductor connected to the second input terminal, and a circuit configured to receive a first signal from the feedback entry conductor and output, on the feedback exit conductor, a second signal as a low pass filtered first signal, the circuit having a variable cut-off frequency of the low pass filtering, wherein each transducer system has a filter adjusting input connected to the circuit for receiving an adjustment signal adjusting the cut-off frequency and where each transducer system receives a different adjustment signal on the filter adjusting input so that the transducer systems are individually corrected to the same desired phase response.

2. An assembly system according to claim 1, wherein the cut-off frequency is 200 Hz or lower.

3. An assembly system according to claim 2, wherein the cut-off frequency is 10-30 kHz.

4. An assembly system according to claim 3, each system further comprising a capacitor connected between the feedback exit conductor and a predetermined voltage of the transducer system.

5. An assembly system according to claim 4, wherein each circuit comprises a converting element configured to convert a received voltage into an output current of the transducer system.

6. An assembly system according to claim 5, wherein the circuit is variable to vary a phase of a signal received on the first input terminal of the transducer system.

7. An assembly system according to claim 6, at least one transducer system further comprising a first voltage supply connected to output a first voltage to the first input terminal, the first transport element comprising a first capacitor of the transducer system.

8. An assembly system according to claim 7, wherein the entry conductor of the at least one transducer system is connected to the first transport element between the first capacitor and the output terminal of the transducer system.

9. An assembly system according to claim 7, wherein the at least one transducer system further comprises a second capacitor between the output terminal and the entry conductor of the transducer system.

10. An assembly system according to claim 7, the at least one transducer system further comprising a third capacitor between the entry conductor and the circuit.

11. An assembly system according to claim 10, the at least one transducer system further comprising an amplifier having and input connected to the output terminal of the transducer system.

* * * * *